US006484429B1

(12) United States Patent
Przylucki

(10) Patent No.: US 6,484,429 B1
(45) Date of Patent: Nov. 26, 2002

(54) MATTRESS SIGN DISPLAY

(75) Inventor: Thomas S. Przylucki, 6714 Walton Heath, Houston, TX (US) 77069

(73) Assignee: Thomas S. Przylucki, Houston, TX (US)

( * ) Notice: Subject to any disclaimer, the term of this patent is extended or adjusted under 35 U.S.C. 154(b) by 0 days.

(21) Appl. No.: 10/117,574

(22) Filed: Apr. 5, 2002

Related U.S. Application Data

(63) Continuation-in-part of application No. 09/617,344, filed on Jul. 17, 2000.

(51) Int. Cl.[7] ..... G09F 3/18

(52) U.S. Cl. ..... 40/661.08; 40/611; 40/735; 40/765; 248/174

(58) Field of Search ..... 40/661.08, 606, 40/661, 750, 1, 672, 453, 539, 611, 729, 735, 765, 791; 248/444.1, 459, 174

(56) References Cited

U.S. PATENT DOCUMENTS

| | | | | | |
|---|---|---|---|---|---|
| 3,945,467 | A | | 3/1976 | Levitz | 186/1 |
| 4,051,615 | A | * | 10/1977 | Gosanko et al. | 40/661 |
| 4,242,817 | A | * | 1/1981 | Ballard | 40/661 |
| 4,329,800 | A | * | 5/1982 | Shuman | 40/606 |
| 4,369,948 | A | * | 1/1983 | Krauss et al. | 108/32 |
| 4,384,416 | A | * | 5/1983 | Kanzelberger | 40/661 |
| D283,954 | S | * | 5/1986 | Daws | D6/310 |
| D298,553 | S | * | 11/1988 | Zobitz | D20/43 |
| D333,163 | S | * | 2/1993 | Mendelsohn | D20/40 |
| 5,456,033 | A | * | 10/1995 | Sachnoff | 40/649 |
| 5,499,407 | A | * | 3/1996 | Atwell et al. | 5/1 |
| D370,355 | S | * | 6/1996 | Kenney | D6/310 |
| D384,655 | S | * | 10/1997 | Knoop | D19/88 |
| 5,701,695 | A | * | 12/1997 | Current | 40/601 |
| 5,855,281 | A | | 1/1999 | Rabas | 211/59.3 |
| 5,887,369 | A | | 3/1999 | Danielczak | 40/428 |
| 5,924,367 | A | * | 7/1999 | Henke et al. | 108/108 |
| 5,983,545 | A | * | 11/1999 | Marco | 248/176.1 |
| 6,009,651 | A | | 1/2000 | Current | 40/605 |
| 6,029,831 | A | * | 2/2000 | Miller | 211/182 |
| D425,566 | S | * | 5/2000 | Mueller et al. | D20/43 |
| 6,070,741 | A | | 6/2000 | Bachman | 211/13.1 |
| 6,308,446 | B1 | * | 10/2001 | Healy | 40/600 |
| 6,332,284 | B1 | * | 12/2001 | Tafforeau | 160/135 |
| 6,347,471 | B1 | * | 2/2002 | Mirza | 40/594 |
| 6,360,465 | B1 | * | 3/2002 | Simpson | 40/638 |
| 6,382,581 | B1 | * | 5/2002 | Duff | 248/165 |

* cited by examiner

*Primary Examiner*—Chris Schwartz
*Assistant Examiner*—Benjamin A. Pezzlo
(74) *Attorney, Agent, or Firm*—Buskop Law Group, P.C.; Wendy Buskop

(57) ABSTRACT

A visual display system comprising: a base; a first vertical front surface connected to the base; an angled back surface connected to the first vertical front surface having an angle of incidence from the first vertical front surface of between 10 and 40 degrees; a vertical back surface connected to the angled back surface having a top edge; a second vertical front surface secured to the top edge forming a first slot between the second vertical front surface and vertical back panel for holding product information; and an angled front panel connected to the second vertical front surface forming a second slot between the angled back surface and the angled front panel for holding product information.

15 Claims, 2 Drawing Sheets

MATTRESS SIGN DISPLAY

The present application is a continuation-in-part application, which claims priority to co-pending application Ser. No. 09/617,344, filed in the U.S. Patent and Trademark Office on Jul. 17, 2000, herein incorporated by reference.

BACKGROUND OF THE INVENTION

The present invention relates to a four panel product display system which includes a basic unit with four panels for viewing product information.

Various display systems exist in the market and in the patent literature. U.S. Pat. No. 5,855,281 is directed to a product display system having a track, with projections and hooks. U.S. Pat. No. 6,070,741 is directed to a merchandise display unit that uses two vertical, parallel, spaced wing walls and a vertical back wall attached to a rear end of the wind wall for multi-planar display of various merchandise. U.S. Pat. No. 5,924,367 is directed to a shelf sign system with various pivotable brackets and panels for displaying product information. U.S. Pat. No. 5,983,545 is directed to a lightweight assembly for displaying a poster, which has crossbars and H-shape and legs. Various other panel display systems are taught in U.S. Pat. Nos. 6,029,831, 3,945,467, 5,887,369, and 6,009,651. Most of these systems have components that are expensive to make, such as metal hardware, and elements, which can rip and tear fabric should they become connected to such material.

The present invention is directed at a low cost multi-panel signage system which can be used particularly on mattresses. None of the patents noted above teach the unique features of the present invention.

SUMMARY OF THE INVENTION

The invention is directed towards a visual display system comprising a base; a first vertical front surface connected to the base; an angled back surface connected to the first vertical front surface having an angle of incidence from the first vertical front surface of between 25 and 65 degrees; a vertical back surface connected to the angled back surface having a top edge; a second vertical front surface secured to the top edge forming a first slot between the second vertical front surface and vertical back panel for holding product information; and an angled front panel connected to the second vertical front surface forming a second slot between the angled back surface and the angled front panel for holding product information.

The invention further includes a vertical display panel molded to the base of clear plastic. It is an object of the present invention to provide a non-tipping display sign, particularly usable for the retail sales of mattresses.

It is an object of the present invention to provide a light, plastic sign, which can display at least 4 product signs, wherein each product sign is a standard 8½×11-inch sheet of paper, or a larger size of paper, such as 8½×14 or 11×17.

It is an object of the present invention to provide an inexpensive new retail sign.

Further and more specific objects and advantages of the present invention will become more readily apparent from the following detailed description of a preferred embodiment thereof taken in conjunction with the drawings.

DETAILED DESCRIPTION

Figure 1:
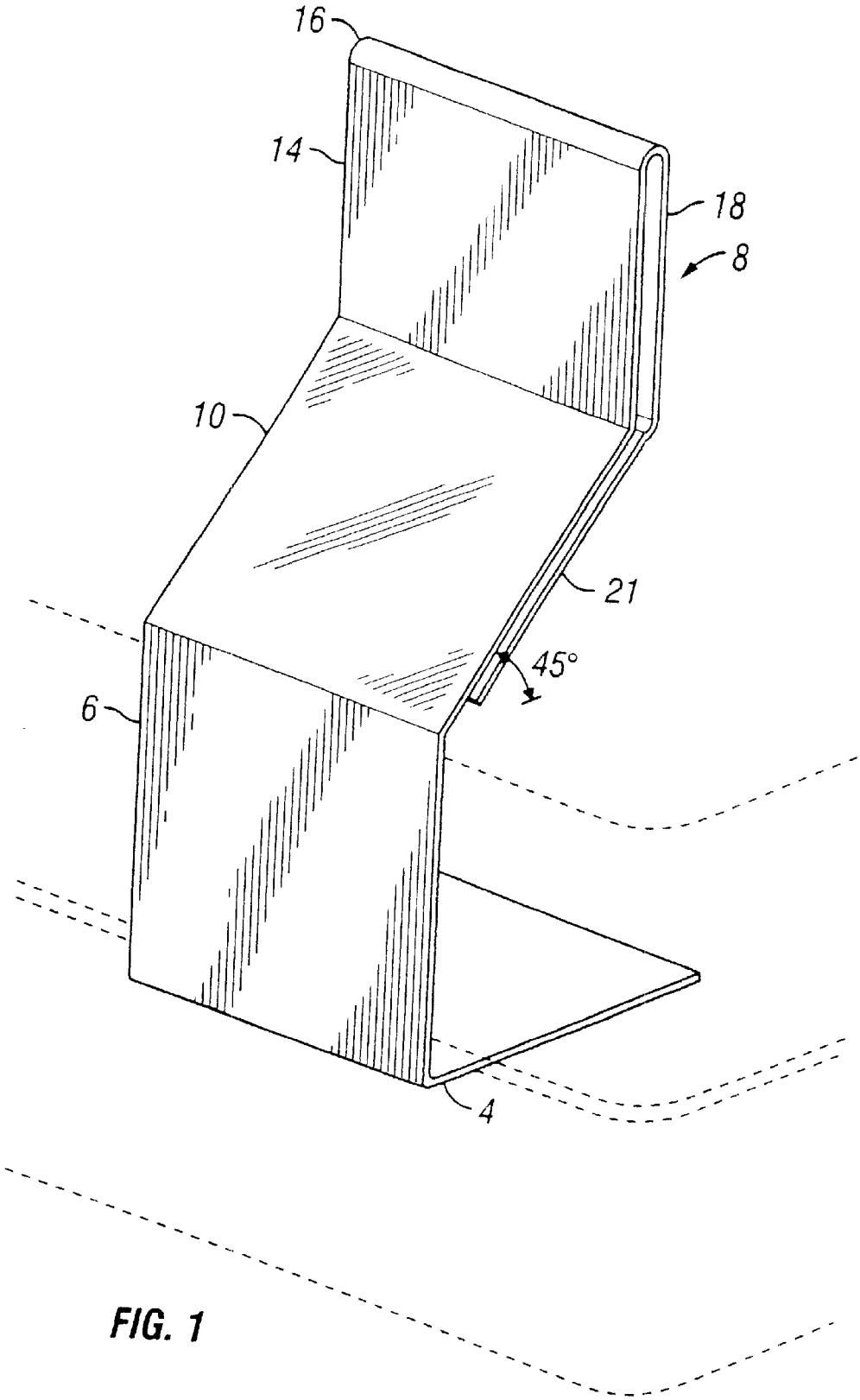
FIG. 1 is a side view of an original embodiment of the invention.

FIG. 1 shows the visual display system 8 of the present invention as filed in the patent case, Ser. No. 09/617,344 having a base 4 with a first vertical front surface 6.

The first vertical front surface 6 is connected to an angled back surface 10, which in turn is connected to a vertical back surface 12. The vertical back surface 12 has a top edge 14 which engages both the vertical back surface 12 and second vertical front surface 16 which is connected to an angled front panel 18.

Top edge 14 is preferably smooth molded plastic, which is molded to both the vertical back surface 12 and the second vertical front surface 16.

In the most preferred embodiment, the plastic used for all parts of the invention is a clear plastic, such as a crystalline polymer, including but not limited to crystalline polyethylene, or crystalling polypropylene/ethylene copolymer.

The angled back surface 10 and the angled front panel 18 are preferably at angles between 20 and 70 degrees from the centerline of the first vertical front surface 6, the vertical back surface 6 and the second vertical front surface 16.

An advertisement 20 slides between angled front panel 18 and angled back surface 10 and between second vertical front surface 16 and vertical back surface 12 and is held in place with a friction grip between these surfaces.

Figure 2:
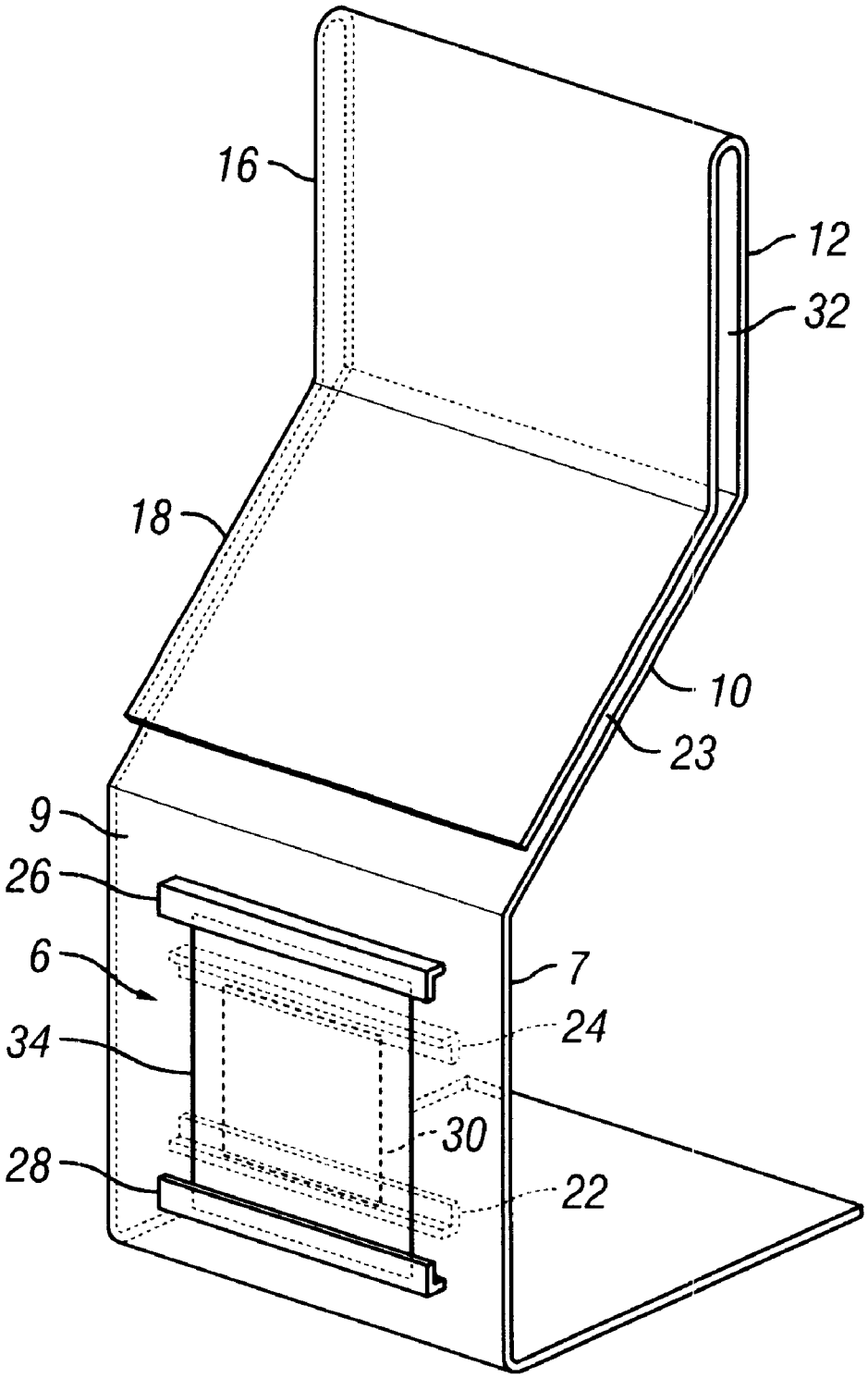
FIG. 2 is a perspective view of a second embodiment of the invention.

When the term "vertical" is used in the specification and claims, this term refers to a vertical or "near vertical" position up to 12 degrees from the vertical plane. FIG. 2 shows the new embodiment of the invention using similar elements of FIG. 1, with the addition of a first bracket 22 and second bracket 24 can be secured to first vertical front surface 6 on the back side to hold further product information or advertising 30 on the display device. This additional bracket enables the display device to display product information on three panels. As an option, but not a requirement for the device, a third bracket 26 and a fourth bracket 28 can be disposed on the first vertical front surface first side. A second advertising piece 34 can be contained between the third bracket 26 and fourth bracket 28. With the optional third and fourth brackets installed, the display system becomes an effective four panel display system, where the display paper does not fall out as easily as with other designs.

The display product information or advertising information 30, 34 and 20 can be fabric swatches, paper ads, or benefits lists regarding the product, namely, the mattress attributes.

In this embodiment, the angled front panel 18 is angled at an angle of incidence relative to the vertical plane of the first vertical front surface 6 between 20 and 70 degrees. The angle of angled back surface 10 can parallel the angle of incidence of angled front panel 18 forming a first slot 23 for holding product literature.

Second vertical front surface 16 parallels vertical back surface 12 forming a second slot 32 between second vertical front surface 16 and vertical back surface 12.

Into these slots 23, and 32, product information can be inserted enabling display of product information through various vertical and angled panels and surfaced without the need for any additional hooks, adhesives or any other material whatsoever.

It is preferred that this product display device is made from one-piece clear plastic which can be hot molded or poured into the correct shape.

It is considered that this invention could be modified so that top edge 14 and the edge at which base 4 meets first vertical front surface 6 could be hinged or latching connections and the device could be a multi-piece construction.

Various devices can be used to hold articles onto the display panels. For example, a product brochure tray, or a tray for holding fabric samples of mattress coverings, or forms for customers to complete can be secured to the front surface of the vertical display panel. Clips rather than brackets can be used to hold these materials to the panels and yet remain within the scope of the invention. It is also the most preferred embodiment that that width of each of those surfaces be 9 inches and capable of accommodating 8½"× 11" paper.

Vertical display panel of the present invention can be etched or painted to add more display information to the display system.

It is preferred that the invention can be constructed such that the panels and surfaces each have a width of between 5 inches and 20 inches, and a height of between 5 inches and 30 inches. However, it is contemplated that the surfaces and panels may have different widths from each other and different heights and remain within the scope of the present invention. From a thickness of the panel viewpoint, it is contemplated that the panels preferably have a thickness of from 1/16–3/8 inches. A preferred embodiment is between 1/8 and 3/8 inches thick. It is also a preferred embodiment to create a visual sign system, which uses plastic sheets as the material for the unit, wherein each sheet has a thickness of between 0.15 and 0.5 inches.

It is contemplated to be within the scope of the invention that the edges of the display device be beveled.

In the preferred embodiment, it is preferred that the base 4 be 12 inches long, although a longer base could be used. The base is to be of a proper thickness to slide between a mattress and box spring. It is also preferred that the base 4 have the same width as the panels.

In the preferred embodiment, it is contemplated that the vertical display panel has an overall height of at least 20 inches. The most preferred embodiment is between 24 and 48 inches in height. A preferred version of the sign is 36 inches in height.

The invention is contemplated as particularly usable on mattresses and box springs for sale in retail showrooms.

It is contemplated that an illumination means could be used secured to the tope edge 16 for illuminating the sign. The illumination means could be halogen or bulbs, battery or 110 volt.

Those skilled in the art will now see that certain modifications can be made to the apparatus and the methods herein disclosed with respect to the illustrated embodiments, without departing from the spirit of the instant invention. While the invention has been described above with respect to the preferred embodiments, it will be understood that the invention is adapted to numerous rearrangements, modifications and alterations and all of such arrangements, modifications and alterations are intended to be within the scope of the appended claims.

What is claimed is:

1. A visual display system comprising:

(a) a base;

(b) a first vertical front surface connected to the base;

(c) an angled back surface connected to the first vertical front surface having an angle of incidence from the first vertical front surface of between 10 and 40 degrees;

(d) a vertical back surface connected to the angled back surface having a top edge;

(e) a second vertical front surface secured to the top edge forming a first slot between the second vertical front surface and vertical back panel for holding product information; and (f) an angled front panel connected to the second vertical front surface forming a second slot between the angled back surface and the angled front panel for holding product information.

2. The visual display system of claim 1, wherein the vertical display panel is made of molded plastic.

3. The visual display system of claim 1, wherein the first vertical front surface comprises brackets for holding product information.

4. The visual display system of claim 1, wherein the first vertical front surface is etched or painted.

5. The visual display system of claim 1; wherein the thickness of the panel and the surfaces is between 1/16 and 3/8 inches.

6. The visual display system of claim 1, wherein the angled back surface is angled between 20 and 70 degrees from the vertical plane of the first vertical front surface.

7. The visual display system of claim 1, wherein the angled back surface and the second vertical front surface each have a width of between 5 inches and 20 inches, and a height of between 5 inches and 30 inches.

8. The visual display system of claim 7, wherein the panels and surfaces are each 9 inches wide and 12 inches high.

9. A visual display system for slidably engaging between a mattress and a box-spring for use in a retail furniture sales setting comprising:

(a) a base;

(b) a first vertical front surface connected to the base;

(c) an angled back surface connected to the first vertical front surface having an angle of incidence from the first vertical front surface of between 20 and 70 degrees;

(d) a vertical back surface connected to the angled back surface having a top edge;

(e) a second vertical front surface secured to the top edge forming a first slot between the second vertical front surface and vertical back panel for holding product information; and (f) an angled front panel connected to the second vertical front surface forming a second slot between the angled back surface and the angled front panel for holding product information.

10. The visual display system of claim 9, wherein the vertical display panel is made of molded plastic.

11. The visual display system of claim 9, wherein the first vertical front surface comprises brackets for holding product information.

12. The visual display system of claim 9, wherein the first vertical front surface is etched or painted.

13. The visual display system of claim 9, wherein the thickness of the panel and the surfaces is between 1/16 and 3/8 inches.

14. The visual display system of claim 9, wherein the angled back surface is angled between 20 and 70 degrees from the vertical plane of the first vertical front surface.

15. The visual display system of claim 9, wherein the angled back surface and the second vertical front surface each have a width of between 5 inches and 20 inches, and a height of between 5 inches and 30 inches.

* * * * *